US011087564B2

(12) United States Patent
Saikawa et al.

(10) Patent No.: US 11,087,564 B2
(45) Date of Patent: Aug. 10, 2021

(54) PERSON DISPLAY CONTROL DEVICE, PERSON DISPLAY CONTROL SYSTEM AND PERSON DISPLAY CONTROL METHOD

(71) Applicant: Mitsubishi Electric Corporation, Tokyo (JP)

(72) Inventors: Yoshinori Saikawa, Tokyo (JP); Tsuyoshi Sempuku, Tokyo (JP); Hisataka Kizu, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/845,803

(22) Filed: Apr. 10, 2020

(65) Prior Publication Data

US 2020/0242851 A1 Jul. 30, 2020

Related U.S. Application Data

(63) Continuation of application No. PCT/JP2017/041508, filed on Nov. 17, 2017.

(51) Int. Cl.

| | |
|---|---|
| ***G07B 15/00*** | (2011.01) |
| ***G08B 13/196*** | (2006.01) |
| ***G08B 25/04*** | (2006.01) |

(52) U.S. Cl.

CPC ..... *G07B 15/00* (2013.01); *G08B 13/196* (2013.01); *G08B 25/04* (2013.01)

(58) Field of Classification Search

CPC ..... G07B 15/04; G08B 13/19613; G08B 13/19615; G08B 13/19617; G08B 13/2454; G08B 13/2462

See application file for complete search history.

(56) References Cited

U.S. PATENT DOCUMENTS 5,021,953 A * 6/1991 Webber ..... G06Q 10/02 705/6
6,998,985 B2 * 2/2006 Reisman ..... G07C 9/28 340/573.1

(Continued)

FOREIGN PATENT DOCUMENTS

DE 102009031019 A1 * 12/2010 ..... G01C 21/206
JP 2003-331323 A 11/2003

(Continued)

OTHER PUBLICATIONS

International Search Report issued in PCT/JP2017/041508 (PCT/ISA/210), dated Feb. 6, 2018.

(Continued)

*Primary Examiner* — Hai Phan
*Assistant Examiner* — Son M Tang
(74) *Attorney, Agent, or Firm* — Birch, Stewart, Kolasch & Birch, LLP

(57) ABSTRACT

A determination unit (6) determines whether a user having entered an authentication area (102) provided on a floor surface is an action-required person. A management unit (12) associates a determination result with respect to an action-required person produced by the determination unit (6) with location information of the user, and records resultant data in a person information database (13). A display control unit (14) controls a display unit (15) to display an image showing a location of an action-required person using the person information database (13).

9 Claims, 7 Drawing Sheets

(56) References Cited

U.S. PATENT DOCUMENTS 7,522,060 B1 * 4/2009 Tumperi ..... G06Q 50/26 340/573.4
7,634,662 B2 * 12/2009 Monroe ..... G08B 25/016 713/186
9,245,175 B1 * 1/2016 Vladimir ..... G07C 9/37
10,607,308 B2 * 3/2020 Burgess ..... H04W 12/08
2004/0088584 A1 * 5/2004 Shachar ..... H04L 63/0428 726/6
2004/0199411 A1 * 10/2004 Bertram ..... G06Q 10/02 705/5
2005/0083171 A1 * 4/2005 Hamilton ..... G08B 21/0288 340/5.7
2005/0197848 A1 * 9/2005 Chou ..... G06Q 30/0281 705/7.41
2007/0206834 A1 * 9/2007 Shinkai ..... H04N 7/181 382/103
2008/0133127 A1 * 6/2008 Havens ..... G06Q 10/06 701/519
2008/0195730 A1 * 8/2008 Hasegawa ..... H04L 67/18 709/224
2009/0322866 A1 * 12/2009 Stotz ..... G07C 9/257 348/77
2010/0148965 A1 * 6/2010 Alexis ..... G06K 19/0723 340/572.1
2010/0268450 A1 * 10/2010 Evanitsky ..... G01C 21/3423 701/533
2012/0032803 A1 * 2/2012 Copeland ..... G08B 13/2431 340/572.1
2013/0002879 A1 * 1/2013 Weber ..... G08B 13/2462 348/159
2014/0162598 A1 * 6/2014 Villa-Real ..... G06Q 20/363 455/411
2014/0347479 A1 * 11/2014 Givon ..... H04N 21/4415 348/143
2015/0036892 A1 * 2/2015 Miller ..... G06Q 10/02 382/115
2015/0279155 A1 * 10/2015 Chun ..... G07F 17/3234 463/25
2015/0286984 A1 * 10/2015 Dikman ..... G06Q 10/087 705/28
2016/0125248 A1 * 5/2016 Lee ..... G06T 7/62 382/103
2017/0032092 A1 * 2/2017 Mink ..... G16H 80/00
2017/0323209 A1 * 11/2017 Rinzler ..... G06Q 30/0201
2018/0115772 A1 * 4/2018 Thompson ..... H04N 13/368
2019/0061619 A1 * 2/2019 Reymann ..... G05D 1/0212

FOREIGN PATENT DOCUMENTS

JP 2009-59168 A 3/2009
JP 2010-97272 A 4/2010
JP 2013-152665 A 8/2013
JP 2015-191597 A 11/2015
JP 2017-92808 A 5/2017
WO WO-2010026521 A1 * 3/2010 ..... H05B 47/155
WO WO-2015168406 A1 * 11/2015 ..... G07C 9/28

OTHER PUBLICATIONS

Notice of Reasons for Refusal , Office Action for counterpart Japanese Application No. 2018-524504, dated Aug. 14, 2018.
Extended European Search Report for European Application No. 17932393.6, dated Sep. 30, 2020.

* cited by examiner

FIG. 3A

| Reference Number | Image | Personal ID | Balance | Pass Coverage | History 1 | History 2 | Property | Monitoring-Needed Person | Assistance-Needed Person | Current Location |
|---|---|---|---|---|---|---|---|---|---|---|
| 12345678 | | AB12CD 34EF | 2,345 | Station A-Station B | Station A-Station C | 123 Yen Product Purchased | Ordinary | NO | NO | West Gate CD-34 |
| 12345679 | | – | – | – | – | – | Non-Carrier | YES | NO | Platform 1 AB-12 |
| 12345680 | | GH56IJ 78KL | 3,456 | – | Station D-Station E | Station F-Station G | White Cane User | NO | YES | East Concourse EF-56 |

FIG. 3B

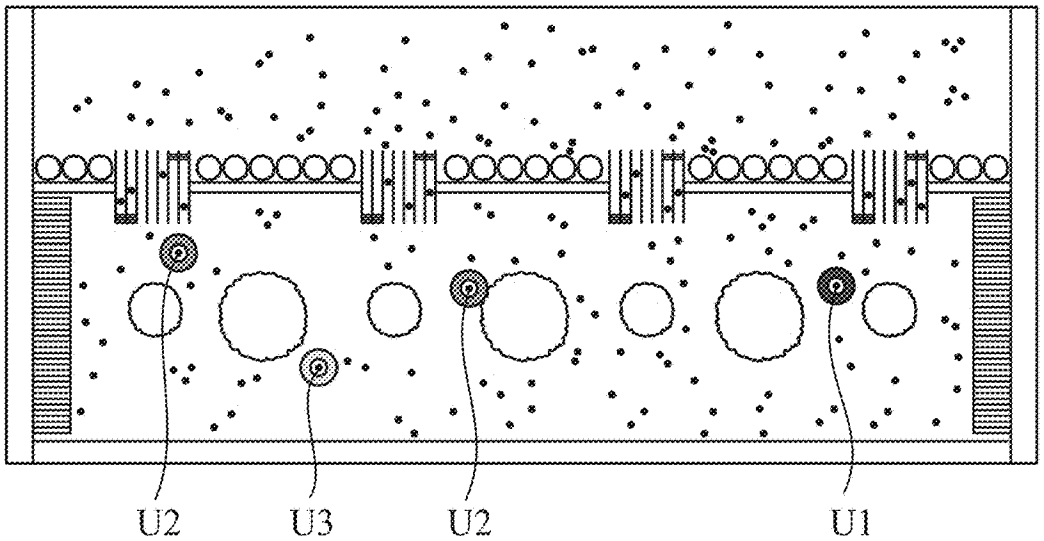

FIG. 7A

| Reference Number | Image | Personal ID | Balance | Pass Coverage | History 1 | History 2 | Property | Monitoring-Needed Person | Assistance-Needed Person | Current Location | Action Status | Person Who Performs Action | Comment |
|---|---|---|---|---|---|---|---|---|---|---|---|---|---|
| 12345678 | | AB12CD 34EF | 2,345 | Station A-Station B | Station A-Station C | 123 Yen Product Purchased | Ordinary | NO | NO | West Gate CD-34 | N/A | N/A | |
| 12345679 | | – | – | – | – | – | Non-Carrier | YES | NO | Platform 1AB-12 | In Action | Yamada Taro | |
| 12345680 | | GH56IJ 78KL | 3,456 | – | Station D-Station E | Station F-Station G | White Cane User | NO | YES | East Concourse EF-56 | Complete | Sato Hanako | Asked For Action At Station G |

FIG. 7B

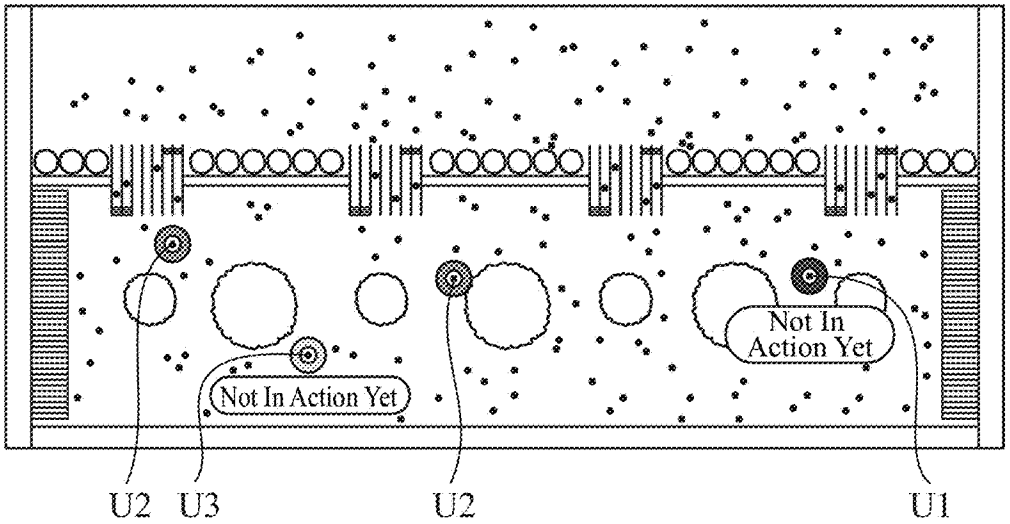

PERSON DISPLAY CONTROL DEVICE, PERSON DISPLAY CONTROL SYSTEM AND PERSON DISPLAY CONTROL METHOD

CROSS REFERENCE TO RELATED APPLICATIONS

This application is a Continuation of PCT International Application No. PCT/JP2017/041508, filed on Nov. 17, 2017, which is hereby expressly incorporated by reference into the present application.

TECHNICAL FIELD

This invention relates to a person display control device that controls a display unit to provide a display regarding a person on that display unit.

BACKGROUND ART

Conventionally, a gate system including a gate device is provided at an entrance of an office building, a ticket gate of a station, and/or the like for the purpose of preventing unauthorized entry of a user. The gate device includes a card reader and a flap. Holding a card over the card reader by a user causes that user to be authenticated, and causes the flap to open.

Another known gate system for preventing unauthorized entry is a flat gate system that provides smooth passage of a user. This flat gate system eliminates a gate device, and assigns an authentication function to the walkway floor surface in place of a card reader, thereby providing an overall configuration of a fully flat shape. Furthermore, examples of a conventional flat gate system include a gate-free ticket gate system of Patent Literature 1.

CITATION LIST

Patent Literature

Patent Literature 1: JP 2013-152665 A

SUMMARY OF INVENTION

Technical Problem

In an office building, a station, an airport, or the like where a flat gate system is provided, security staff, station staff, or the like is required to stop an unauthorized user to give a warning, to ask a user needing assistance about necessity for assistance, or to take other action. This requires security staff, station staff, or the like to recognize the location of an action-required person, such as an unauthorized user and a user needing assistance.

For example, the gate-free ticket gate system of Patent Literature 1 mentioned above displays a determination result of whether use of the station by a user is unauthorized use or not by lighting or blinking, with a specific color, of a display unit included in a floor unit in contact with that user. In this process, the floor unit to be lit also changes to another with the movement of the user examined. By seeing a light-emitting floor unit indicating unauthorized use, station staff, another nearby user, and the like can know that an unauthorized user is on that floor unit. On the other hand, unless station staff or the like is at a place where the display unit of the floor unit on which the unauthorized user is standing can be seen, the station staff or the like cannot recognize the location of the unauthorized user. For example, it is hard for station staff distant from the unauthorized user to identify the place of the unauthorized user. Alternatively, even if a display unit is provided at a place apart from the unauthorized user such as in a station staff room, and the display unit is caused to light with a specific color when there is an unauthorized user, the station staff or the like who sees the display can know presence or absence of an unauthorized user, but cannot know the location thereof. Thus, in order to indicate the location of an unauthorized user, the gate-free ticket gate system of Patent Literature 1 mentioned above requires the display unit to be provided in the place where the user is present, specifically, in the floor unit where the user is standing.

This invention has been made to solve the problem described above, and it is an object of the present invention to provide a display control device capable of providing a display for recognizing, at a place apart from an action-required person, the location of that person.

Solution to Problem

A display control device according to this invention includes processing circuitry to acquire authentication information of a user having entered an authentication area provided on a floor surface, the authentication information including information as to whether the user needs assistance, to determine whether the user is an action-required person using acquisition information indicating whether the authentication information of the user has been acquired, or using the authentication information of the user acquired, to acquire location information of the user, to associate a determination result produced by the determination using the acquisition information or the authentication information with the location information acquired, and record resultant data in a person information database, and to control, on a basis of the determination result produced by the determination recorded in the person information database, a display to display an image showing a location of the action-required person.

Advantageous Effects of Invention

According to this invention, the determination result of whether the user is the action-required person is associated with the location information of the user, and the resultant data is recorded in the person information database, and this database is then used for display control. This enables a display to be provided for recognizing, at a place apart from the action-required person, the location of the person.

BRIEF DESCRIPTION OF DRAWINGS

FIGS. 3A and 3B are diagrams each illustrating an example of display appearance of information recorded in a person information database of the first embodiment.

FIGS. 7A and 7B are diagrams each illustrating an example of display appearance of information recorded in a person information database of the second embodiment.

DESCRIPTION OF EMBODIMENTS

To describe this invention in more detail, embodiments of this invention will be described below with reference to the accompanying drawings.

First Embodiment

Figure 1:
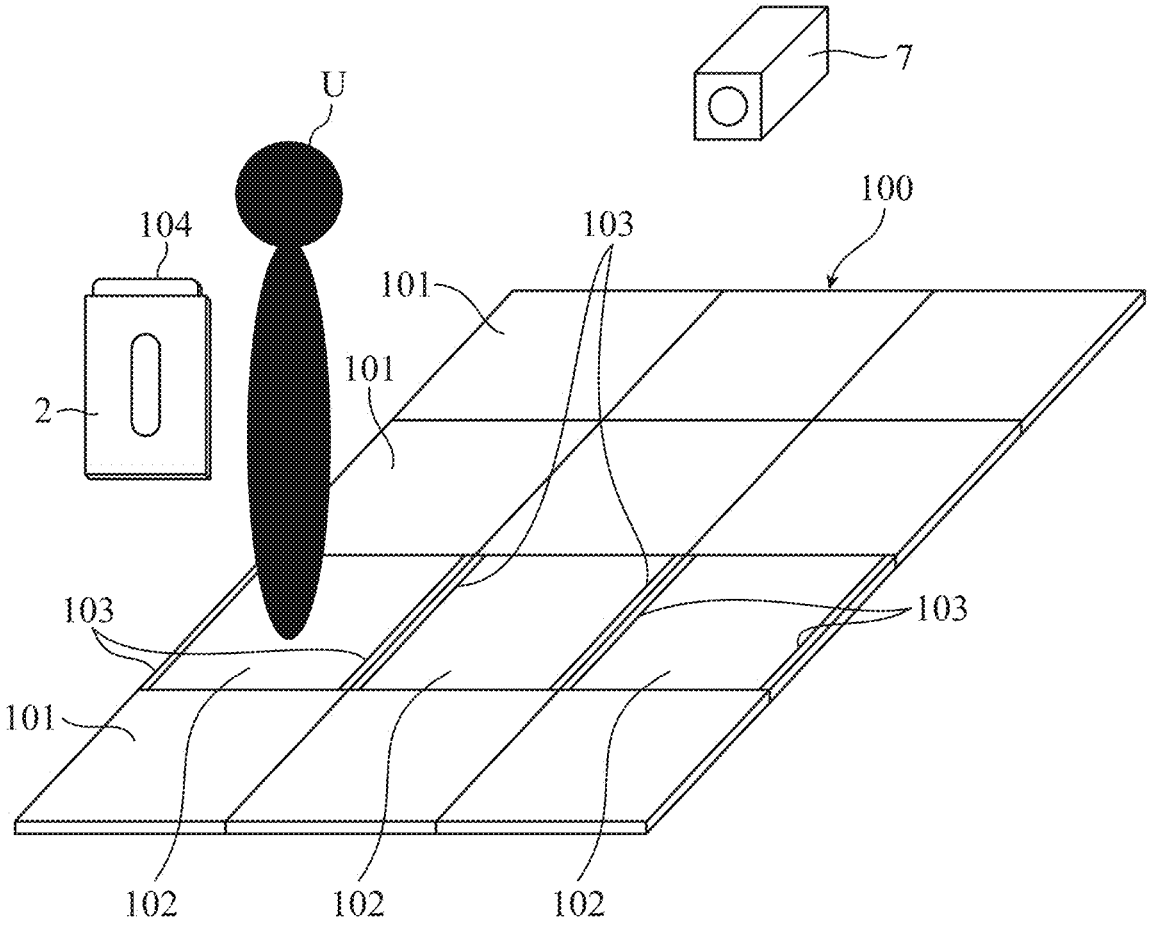
FIG. 1 is a diagram illustrating a situation when a user U has entered a building where a person display control system according to a first embodiment is applied.

FIG. 1 is a diagram illustrating a situation when a user U has entered a building where a person display control system 1 according to a first embodiment is applied.

Description will be given below, as an example, of a case in which the person display control system 1 according to the first embodiment is applied to a station.

As illustrated in FIG. 1, a ticket gate walkway 100 of a station provides a walkway passable by a user that uses the station.

The ticket gate walkway 100 is paved with multiple floor panels 101 without a gap therebetween, and each of the floor panels 101 is a plate-shaped rectangular floorboard. That is, the floor surface of the ticket gate walkway 100 is formed by the multiple floor panels 101. In addition, multiple floor panels 101 provided at predetermined locations, of the multiple floor panels 101 forming the floor surface of the ticket gate walkway 100, each have a surface configured to serve as an authentication area 102.

Note that FIG. 1 representatively illustrates three authentication areas 102 of the multiple authentication areas 102 provided on the floor surface. In addition, in FIG. 1, the three authentication areas 102 are illustrated as being provided next to each other, but may be provided scatteredly on the ticket gate walkway 100. Moreover, the number of the authentication areas 102 may be one. Furthermore, neighboring floor panels 101 may together constitute one authentication area 102.

The floor panels 101 forming the authentication area(s) 102 each have, on both sides, a light emitting area 103 including, for example, an arrangement of multiple light emitting diodes.

As illustrated in FIG. 1, the user U is carrying a card holder 2. The card holder 2 is for holding an integrated circuit (IC) card 104 that can be used when the user U takes a train. Multiple users who pass through the ticket gate walkway 100 each carry the card holder 2 of their own holding the IC card 104.

The IC card 104 serves as a pass such as a ticket or a train pass, and the IC card 104 stores, in advance, authentication information of a user authorized to use the IC card. This authentication information includes, for example, the full name of the user, the personal identification (ID) that identifies the user, pass coverage information, pass expiration information, a boarding-alighting history, and balance information.

As illustrated in FIG. 1, the ticket gate of a station where the person display control system 1 according to the first embodiment is applied has no gate device. More specifically, although a typical gate system includes a gate device having a card reader over which a user holds the IC card 104 and a flap to prevent unauthorized entry of a user, the ticket gate of a station illustrated in FIG. 1 does not include such a gate device. This ticket gate is structured to be generally flat by including only the multiple floor panels 101 placed thereover next to each other. When a user carrying the card holder 2 is about to enter space over the authentication areas 102 of the ticket gate walkway 100, the authentication information stored in the IC card 104 in the card holder 2 is received by a receiving unit 3 (described later), and ticket inspection is thereby performed.

Figure 2:
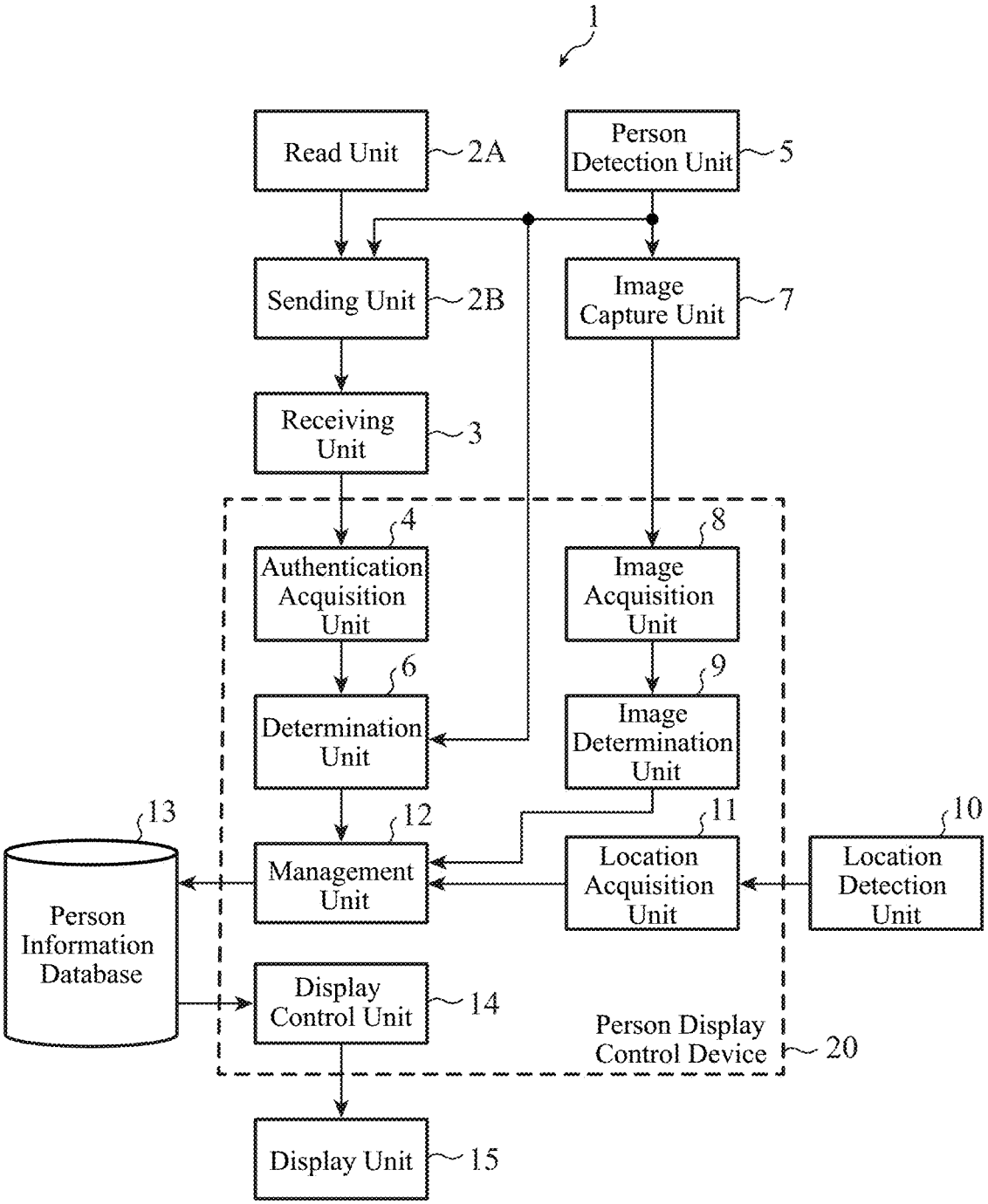
FIG. 2 is a diagram illustrating a configuration of the person display control system according to the first embodiment.

FIG. 2 is a diagram illustrating a configuration of the person display control system 1 according to the first embodiment.

The person display control system 1 includes a read unit 2A, a sending unit 2B, the receiving unit 3, an authentication acquisition unit 4, a person detection unit 5, a determination unit 6, an image capture unit 7, an image acquisition unit 8, an image determination unit 9, a location detection unit 10, a location acquisition unit 11, a management unit 12, a person information database 13, a display control unit 14, and a display unit 15.

The read unit 2A reads authentication information of a user from the IC card 104 storing the authentication information. The read unit 2A is incorporated in the card holder 2 carried by the user. The read unit 2A is a card reader. The read unit 2A outputs the authentication information that has been read, to the sending unit 2B.

The sending unit 2B sends the authentication information read by the read unit 2A. The sending unit 2B is incorporated in the card holder 2 together with the read unit 2A. The sending unit 2B is, for example, an electrode or an antenna.

For example, when receiving a request from the person detection unit 5, the sending unit 2B sends the authentication information. Alternatively, when receiving a request from a sending request unit not shown, the sending unit 2B may send the authentication information. Further alternatively, the sending unit 2B may send the authentication information at preset intervals.

Note that, in a case in which a smartphone serves as a pass such as a ticket or a train pass, and the smartphone stores the authentication information of the user, the read unit 2A may read the authentication information from the smartphone. In this case, for example, the case that holds the smartphone is configured to include therein the read unit 2A and the sending unit 2B. Alternatively, the smartphone may be configured so that the processor thereof functions as the read unit 2A, and the antenna thereof functions as the sending unit 2B to send the authentication information stored in the memory of the smartphone.

In short, the read unit 2A may be of any kind that can read the authentication information from a card, a device, or a memory storing the authentication information.

The receiving unit 3 receives the authentication information sent from the sending unit 2B. The receiving unit 3 is, for example, an electrode or an antenna. The receiving unit 3 is provided close to one of the authentication areas 102 (hereinafter referred to simply as "the authentication area 102"), for example, under the authentication area 102. The receiving unit 3 outputs the received authentication information to the authentication acquisition unit 4.

Communication between the sending unit 2B and the receiving unit 3 is contactless communication using an electric field or a radio wave. Such communication is, for example, communication via a Bluetooth (registered trademark) or Wi-Fi connection, or via intra-body communication.

The authentication acquisition unit 4 acquires the authentication information received by the receiving unit 3, and outputs the authentication information to the determination unit 6.

The person detection unit 5 detects that a user has entered the authentication area 102. Note that the phrase "to enter the authentication area 102" herein means entering space over the authentication area(s) 102. The person detection unit 5 is, for example, a weight sensor provided under the authentication area 102. Alternatively, the person detection unit 5 may also be an infrared sensor having a detection area covering space over the authentication area(s) 102. Further alternatively, the person detection unit 5 may include a camera for capturing an image of space over the authentication area(s) 102, and an image processing device that performs image processing on the basis of image data of the image captured by the camera. In this case, the camera included in the person detection unit 5 may also be the camera included in the image capture unit 7.

Upon detection that a user has entered the authentication area 102, the person detection unit 5 informs, of the detection, the sending unit 2B, the determination unit 6, and the image capture unit 7.

The determination unit 6 determines, using information indicating whether the authentication information of the user has been acquired, or using the authentication information of the user acquired by the authentication acquisition unit 4, whether the user is an action-required person. Examples of the action-required person include a non-carrier and an unauthorized person. The term "non-carrier" herein refers to a user whose authentication information is unobtainable, specifically, for example, a user not carrying the card holder 2 and the IC card 104. In addition, the term "unauthorized person" herein refers to a user not authorized to pass through, specifically, for example, a user carrying an expired train pass, a user having an inconsistent boarding-alighting history, or a user having an insufficient balance.

For example, upon being informed by the person detection unit 5 that a user has entered the authentication area 102, and when authentication information is nevertheless not output from the authentication acquisition unit 4, the determination unit 6 determines that authentication information of the user is unobtainable, and that the user is a non-carrier. Alternatively, if the authentication information of the user acquired by the authentication acquisition unit 4 indicates that the train pass is expired, the determination unit 6 determines that the user is an unauthorized person. Further alternatively, if the authentication information of the user acquired by the authentication acquisition unit 4 indicates a balance that is less than the train fare calculated on the basis of the boarding-alighting history provided by the authentication information, the determination unit 6 determines that the user is an unauthorized person.

The determination unit 6 outputs a determination result to the management unit 12. Note that the determination unit 6 may output a determination result merely indicating whether the user is an action-required person or not, or may output a determination result indicating the specific reason for the necessity of action. Examples of the specific reason for the necessity of action include being a non-carrier, being an unauthorized person, having an inconsistent boarding-alighting history, and having an insufficient balance.

As illustrated in FIG. 1, the image capture unit 7 is a camera for capturing an image of space over the authentication area(s) 102. Upon being informed by the person detection unit 5 that a user has entered the authentication area 102, the image capture unit 7 outputs image data of the captured image to the image acquisition unit 8. The image data is image data of the captured image of the user having entered the authentication area 102.

The image acquisition unit 8 acquires the image data of the captured image of the user output by the image capture unit 7, and outputs the image data to the image determination unit 9.

The image determination unit 9 determines whether the user having entered the authentication area 102 is an action-required person, using the image data acquired by the image acquisition unit 8. Examples of a user determined by the image determination unit 9 to be an action-required person include an assistance-needed person and a monitoring-needed person. The term "assistance-needed person" herein refers to a user who may need assistance, specifically, for example, a user using a white cane, a user led by a guide dog, or a user using a wheelchair. The term "monitoring-needed person" herein refers to a user who should be monitored for security reason, specifically, for example, a user acting suspiciously or a user carrying a dangerous article. The image determination unit 9 performs image processing on the basis of the image data of the captured image of the user, and thereby determines whether the user is an assistance-needed person or a monitoring-needed person.

As described above, the image determination unit 9 determines whether the user is an action-required person on the basis of an appearance feature of the user.

The image determination unit 9 outputs a determination result to the management unit 12. Note that the image determination unit 9 may output a determination result merely indicating whether the user is an action-required person or not, or may output a determination result indicating the specific reason for the necessity of action. Examples of the specific reason for the necessity of action include being an assistance-needed person, being a monitoring-needed person, using a white cane, and carrying a dangerous article.

Note that the image acquisition unit 8 and the image determination unit 9 may be incorporated in the image capture unit 7, or otherwise be configured in a server not shown communicable with the image capture unit 7 and with the management unit 12.

In addition, the light emitting areas 103 illustrated in FIG. 1 may be caused to emit light when the determination unit 6 or the image determination unit 9 determines that the user is a non-carrier, an unauthorized person, or a monitoring-needed person.

The location detection unit 10 detects the location of the user having entered the authentication area 102 even after the user passes through the authentication areas 102, and outputs location information of the user to the location acquisition unit 11. The location detection unit 10 is provided at each of various places in the station.

The location detection unit 10 includes, for example, a camera, and an image processing device that performs image processing on the basis of image data of an image captured by this camera. The location detection unit 10 refers to user image data stored in the person information database 13 to identify the user whose image is being processed, and then outputs the location information in a form which makes it possible to reveal who is corresponding to the location information. In addition, the location detection unit 10 may output the image data of the captured image of the user, to the location acquisition unit 11, together with the location information of the user. This enables the management unit 12 that has obtained the image data via the location acquisition unit 11 to update the user image data in the person information database 13.

Alternatively, the location detection unit 10 may detect the location of the user utilizing a configuration in which the sending unit 2B is incorporated in the card holder 2 carried by the user. In this case, similarly to the receiving unit 3, the location detection unit 10 is configured to receive the authentication information sent by the sending unit 2B; and in addition, the sending unit 2B is configured to send the authentication information at preset intervals. Upon reception of the authentication information from the sending unit 2B that has entered a detection area, the location detection unit 10 outputs location information together with the authentication information. The location indicated by the location information corresponds to, for example, the location where the location detection unit 10 is provided. By also outputting the authentication information, the location detection unit 10 makes it possible to reveal who is corresponding to the location information.

The location detection unit 10 including, for example, as described above, a camera or a device that communicates with the sending unit 2B may precisely detect the location of the user to provide location information, or may detect the area where the user is present among multiple divided areas inside the station to provide location information.

The location acquisition unit 11 acquires the location information of the user output by the location detection unit 10, and outputs the location information to the management unit 12.

The management unit 12 associates the determination result produced by the determination unit 6 and the determination result produced by the image determination unit 9 with the location information acquired by the location acquisition unit 11, and records the resultant data in the person information database 13.

FIG. 3A is a diagram illustrating an example of display appearance of information recorded in the person information database 13. The person information database 13 includes information indicating, for example, a reference number, an image, the personal ID, the balance, the pass coverage, the history, a property, whether the user is a monitoring-needed person or not, whether the user is an assistance-needed person or not, and the current location, recorded on a per-user basis.

The reference number is a number assigned, upon recording of the information on a user having entered the authentication area 102 in the person information database 13, to the user. The image is an image indicated by image data of the image captured by the image capture unit 7. The personal ID, the balance, the pass coverage, and the history are those indicated by the authentication information. The property, whether the user is a monitoring-needed person or not, and whether the user is an assistance-needed person or not are those indicated by the determination results produced by the determination unit 6 and by the image determination unit 9.

The person information database 13 is implemented in a hard disk drive (HDD) or the like.

The display control unit 14 controls the display unit 15 to display an image showing the location of an action-required person, using the person information database 13. Specifically, the display control unit 14 generates an image signal, and outputs the image signal to the display unit 15. For example, the display control unit 14 outputs, to the display unit 15, an image signal indicating an image such as the image of FIG. 3A. As described above, the display control unit 14 generates an image signal that enables the locations of multiple action-required persons to be viewed at one time in a list format on the single display unit 15.

As illustrated as "ordinary" in FIG. 3A, the display control unit 14 may control the display unit 15 to also display an image showing the location of an ordinary person, who is a user other than an action-required person. In short, the display control unit 14 needs to control the display unit 15 to display an image showing at least the location(s) of the action-required person(s).

Although not shown in FIG. 3A, if a "property" cell includes a description of an inconsistent boarding-alighting history, insufficient balance, or the like, station staff can use the display of the display unit 15 to monitor whether the user takes a prescribed action such as reloading money at a reloading machine or reporting at a service counter.

In addition, as illustrated in FIG. 3A, display of the pass coverage included in the authentication information read from the IC card 104 enables station staff to know at which station the user will alight. This then enables the station staff to quickly ask station staff at the station at which a user who is displayed as an assistance-needed person will alight for an action for the user.

In the case in which the location is also to be displayed of a user who is not an action-required person, the display control unit 14 displays an action-required person and a user who is not an action-required person differently. Specifically, the display control unit 14 displays an action-required person and a user who is not an action-required person using different display colors, display shapes, display sizes, or the likes. For example, when the locations of users are superimposed on a station floor map, which is a map of the inside of the station, as described later herein, the display control unit 14 displays an image in which the location of an action-required person is displayed using a red circle, and the location of a user who is not an action-required person is displayed using a blue circle. In addition, the display control unit 14 may use a different display for each specific reason for the necessity of action, by, for example, assigning different display colors to an unauthorized person and an assistance-needed person, both being action-required persons.

Note that, to enable station staff and/or the like who sees the display unit 15 to readily recognize the location of an action-required person, the display control unit 14 preferably controls the display unit 15 to display an image in which the location of an action-required person is superimposed on a station floor map. The station floor map may be a photographed floor map created by photographing the inside of the station, a floor map generated using computer graphics (CG), or an illustrated floor map. An example of an image in which the locations of action-required persons are superimposed on a station floor map is illustrated in FIG. 3B. FIG. 3B illustrates the locations by circling a monitoring-needed person U1 using the darkest gray circle, assistance-needed persons U2 using the next darkest gray circles, and a non-carrier U3 using the lightest gray circle.

The authentication acquisition unit 4, the determination unit 6, the image acquisition unit 8, the image determination unit 9, the location acquisition unit 11, the management unit 12, and the display control unit 14 are included in a person display control device 20.

The display unit 15 is controlled by the display control unit 14 to display an image. Specifically, the display unit 15 displays an image indicated by an image signal generated by the display control unit 14. The display unit 15 is, for example, the display of a personal computer used by the station staff, the display of a smartphone carried by the station staff, or the display of a tablet terminal carried by the station staff.

Examples of a hardware configuration of the person display control device 20 will next be described with reference to FIGS. 4A and 4B.

The functions of the authentication acquisition unit 4, the determination unit 6, the image acquisition unit 8, the image determination unit 9, the location acquisition unit 11, the management unit 12, and the display control unit 14, of the person display control device 20 are implemented by a processing circuit. The processing circuit may be a dedicated hardware element, or may be a central processing unit (CPU) that executes a program stored in a memory. The CPU is also referred to as a central processing device, a processing unit, a computing unit, a microprocessor, a microcomputer, a processor, or a digital signal processor (DSP).

Figure 4A:
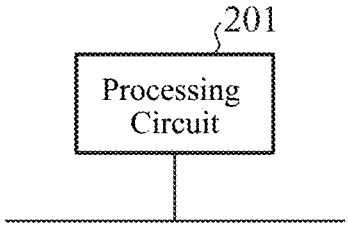
FIGS. 4A and 4B are diagrams each illustrating an example of a hardware configuration of a person display control device according to the first embodiment.

FIG. 4A is a diagram illustrating an example of the hardware configuration in a case in which the functions of the authentication acquisition unit 4, the determination unit 6, the image acquisition unit 8, the image determination unit 9, the location acquisition unit 11, the management unit 12, and the display control unit 14 are implemented by a processing circuit 201, which is a dedicated hardware element. The processing circuit 201 is, for example, a single circuit, a set of multiple circuits, a programmed processor, a parallel programmed processor, an application specific integrated circuit (ASIC), a field programmable gate array (FPGA), or a combination thereof. The functions of the authentication acquisition unit 4, the determination unit 6, the image acquisition unit 8, the image determination unit 9, the location acquisition unit 11, the management unit 12, and the display control unit 14 may be implemented by a combination of two or more processing circuits 201, or the functions of these units may be implemented by a single processing circuit 201.

Figure 4B:
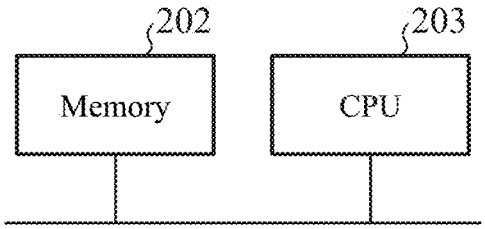

FIG. 4B is a diagram illustrating an example of the hardware configuration in a case in which the functions of the authentication acquisition unit 4, the determination unit 6, the image acquisition unit 8, the image determination unit 9, the location acquisition unit 11, the management unit 12, and the display control unit 14 are implemented by a CPU 203 that executes a program stored in a memory 202. In this case, the functions of the authentication acquisition unit 4, the determination unit 6, the image acquisition unit 8, the image determination unit 9, the location acquisition unit 11, the management unit 12, and the display control unit 14 are implemented by software, firmware, or a combination of software and firmware. The software or firmware is described as a program or programs, and is stored in the memory 202. The CPU 203 reads and executes a program stored in the memory 202 to implement the functions of the authentication acquisition unit 4, the determination unit 6, the image acquisition unit 8, the image determination unit 9, the location acquisition unit 11, the management unit 12, and the display control unit 14. More specifically, the person display control device 20 includes the memory 202 for storing programs or the likes that cause steps ST2 to ST14 illustrated in the flowchart of FIG. 5 described later to be performed as a result. In addition, it can also be said that these programs cause a computer to perform a procedure or method which each of the authentication acquisition unit 4, the determination unit 6, the image acquisition unit 8, the image determination unit 9, the location acquisition unit 11, the management unit 12, and the display control unit 14 uses. In this regard, the memory 202 is, for example, a non-volatile or volatile semiconductor memory, such as a random access memory (RAM), a read-only memory (ROM), a flash memory, an erasable programmable ROM (EPROM), and an electrically erasable programmable ROM (EEPROM); a disk-shaped recording medium, such as a magnetic disk, a flexible disk, an optical disk, a compact disc, a MiniDisc, and a digital versatile disc (DVD); or the like.

Note that the functions of the authentication acquisition unit 4, the determination unit 6, the image acquisition unit 8, the image determination unit 9, the location acquisition unit 11, the management unit 12, and the display control unit 14 may be partially implemented by a dedicated hardware element, and partially implemented by software or firmware. For example, the functions of the authentication acquisition unit 4, the determination unit 6, the image acquisition unit 8, and the image determination unit 9 can be implemented by a processing circuit as a dedicated hardware element, and the functions of the location acquisition unit 11, the management unit 12, and the display control unit 14 can be implemented by a processing circuit which reads and executes a program stored in a memory.

As described above, the processing circuit can implement the functions of the authentication acquisition unit 4, the determination unit 6, the image acquisition unit 8, the image determination unit 9, the location acquisition unit 11, the management unit 12, and the display control unit 14 by using hardware, software, firmware, or a combination thereof.

Figure 5:
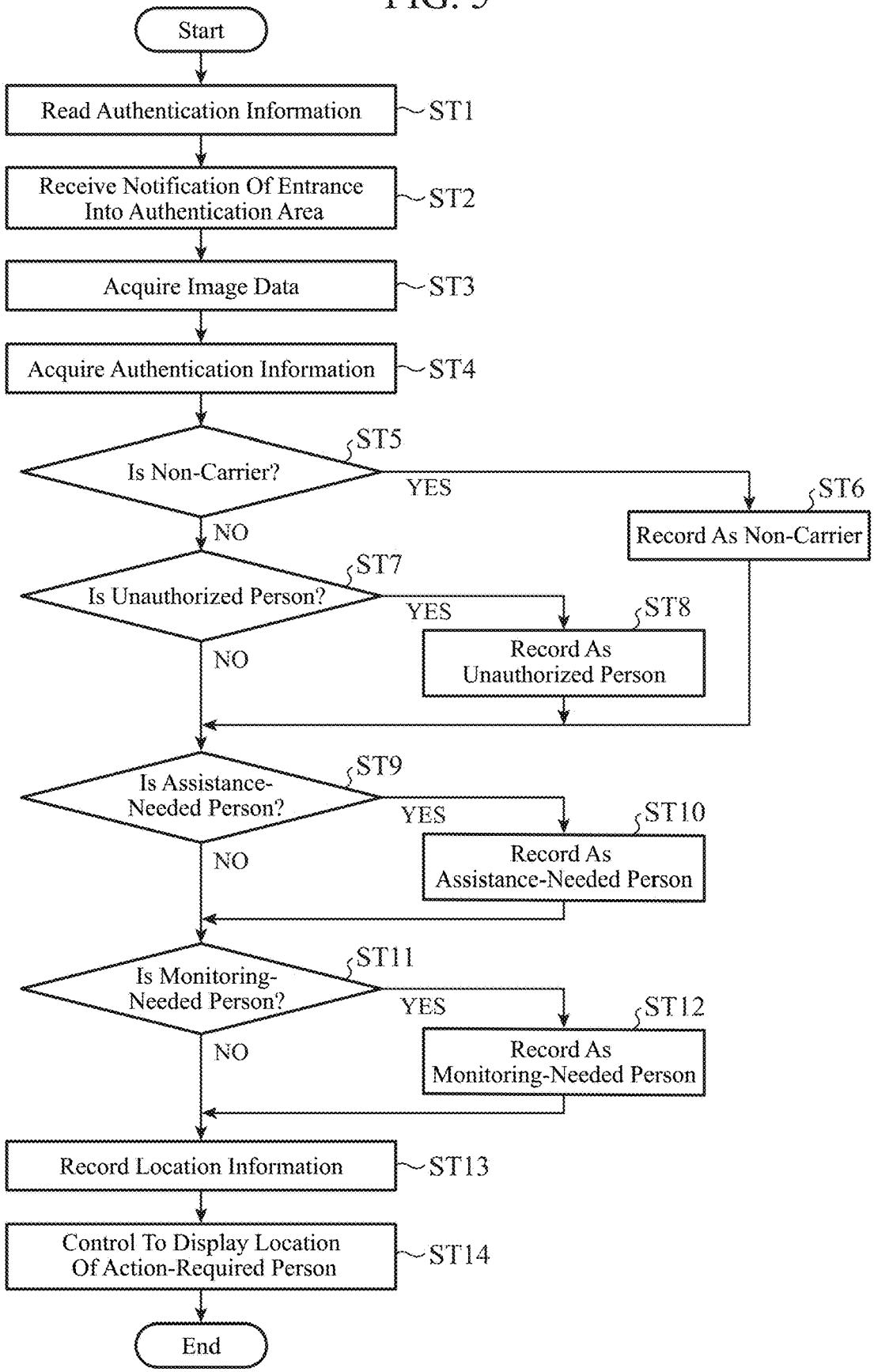
FIG. 5 is a flowchart illustrating an example of a process performed by the person display control system according to the first embodiment.

An example of a process performed by the person display control system 1 configured as described above will next be described with reference to the flowchart illustrated in FIG. 5.

The read unit 2A reads authentication information of a user stored in the IC card 104 in the card holder 2 carried by the user (step ST1). The read unit 2A outputs the authentication information read, to the sending unit 2B.

Next, when the user enters the authentication area 102, the person detection unit 5 detects that the user has entered the authentication area 102. Then, the determination unit 6 receives, from the person detection unit 5, a notification that the user has entered the authentication area 102 (step ST2). The person detection unit 5 sends the notification that the user has entered the authentication area 102 also to the sending unit 2B and to the image capture unit 7.

Upon reception of the notification from the person detection unit 5, the image capture unit 7 outputs image data of a captured image. The image data output is received by the image acquisition unit 8 (step ST3). The image acquisition unit 8 outputs the image data obtained, to the image determination unit 9. Thus, the image determination unit 9 obtains the image data of the user having entered the authentication area 102.

In addition, in parallel with step ST3, the sending unit 2B sends the authentication information read by the read unit 2A upon reception of the notification from the person detection unit 5. Thus, the notification from the person detection unit 5 to the sending unit 2B is substantially a send request for the authentication information. The authentication information of the user having entered the authentication area 102 sent from the sending unit 2B is received by the authentication acquisition unit 4 via the receiving unit 3 (step ST4). The authentication information is then output from the authentication acquisition unit 4 to the determination unit 6.

Note that the operations at steps ST1 and ST4 are not performed when the user does not carry the card holder 2 and the IC card 104.

Then, the determination unit 6 determines whether the user having entered the authentication area 102 is a non-carrier (step ST5).

If the user having entered the authentication area 102 is not a non-carrier, the determination unit 6 is expected to be able to obtain a notification that the user has entered the authentication area 102 from the person detection unit 5, and to obtain authentication information from the authentication acquisition unit 4. Thus, if the determination unit 6 obtains a notification that the user has entered the authentication area 102 from the person detection unit 5, and obtains authentication information from the authentication acquisition unit 4, the determination unit 6 determines that the user having entered the authentication area 102 is not a non-carrier. Otherwise, if the determination unit 6 obtains a notification that the user has entered the authentication area 102 from the person detection unit 5, but cannot obtain authentication information from the authentication acquisition unit 4, the determination unit 6 determines that the user having entered the authentication area 102 is a non-carrier.

The determination unit 6 outputs, to the management unit 12, a determination result indicating whether the user having entered the authentication area 102 is a non-carrier or not.

As described above, on the basis of whether authentication information of the user having entered the authentication area 102 has been obtained or not, the determination unit 6 determines whether the user is a non-carrier.

Note that, considering a possible time difference between outputting from the person detection unit 5 to the determination unit 6 and outputting from the authentication acquisition unit 4 to the determination unit 6, the determination unit 6 is preferably configured to wait during a specified time period after receiving an output from one of the person detection unit 5 and the authentication acquisition unit 4, for an output from the other.

If the determination unit 6 determines that the user having entered the authentication area 102 is a non-carrier (step ST5; YES), the management unit 12 records the user as a non-carrier in the person information database 13 (step ST6). In this operation, the management unit 12, for example, assigns a reference number to the user to allow information to be manageable on a per-user basis in the person information database 13. In addition, the management unit 12 may acquire the image data of the user from the image acquisition unit 8, associate the image data with the determination result produced by the determination unit 6 at step ST5, and record the resultant data in the person information database 13. After the operation at step ST6, the operation at step ST9 is performed.

Meanwhile, if the determination unit 6 determines that the user having entered the authentication area 102 is not a non-carrier (step ST5; NO), the authentication information has already been output from the authentication acquisition unit 4 to the determination unit 6. Thus, the determination unit 6 determines whether the user is an unauthorized person using the authentication information (step ST7). For example, in a case of having an insufficient balance or an inconsistent boarding-alighting information history, the determination unit 6 determines that the user is an unauthorized person.

The determination unit 6 outputs a determination result indicating whether the user is an unauthorized person or not, and, in addition, also indicating the specific reason such as having an insufficient balance, to the management unit 12.

If the determination unit 6 determines that the user having entered the authentication area 102 is an unauthorized person (step ST7; YES), the management unit 12 records the user as an unauthorized person in the person information database 13 (step ST8). If the specific reason such as having an insufficient balance is indicated in the determination result from the determination unit 6, the management unit 12 also records the specific reason in the person information database 13. In this operation, for example, the management unit 12 assigns a reference number to the user to allow information to be manageable on a per-user basis in the person information database 13. In addition, the management unit 12 may acquire the image data of the user from the image acquisition unit 8, associate the image data with the determination result produced by the determination unit 6 at step ST7, and record the resultant data in the person information database 13.

After the operation at step ST8, or if the determination unit 6 determines that the user having entered the authentication area 102 is not an unauthorized person (step ST7; NO), the operation at step ST9 is performed.

Next, the image determination unit 9 determines whether the user having entered the authentication area 102 is an assistance-needed person, using the image data acquired by the image acquisition unit 8 (step ST9).

The image determination unit 9 outputs, to the management unit 12, a determination result indicating whether the user having entered the authentication area 102 is an assistance-needed person or not, and in addition, if the user having entered the authentication area 102 is an assistance-needed person, also indicating the specific reason such as use of a white cane.

If the image determination unit 9 determines that the user having entered the authentication area 102 is an assistance-needed person (step ST9; YES), the management unit 12 records the user as an assistance-needed person in the person information database 13 (step ST10). If the specific reason such as use of a white cane is indicated in the determination result from the image determination unit 9, the management unit 12 also records the specific reason in the person information database 13. In this operation, if information on the user has already been recorded in the person information database 13 by the operation at step ST6 or the like, the management unit 12 additionally records the determination result produced by the image determination unit 9 at step ST9 in association with the already-recorded information. Otherwise, if no information on the user has yet been recorded in the person information database 13, the management unit 12, for example, assigns a reference number to the user, and newly records the determination result produced by the image determination unit 9 at step ST9 in the person information database 13.

If the image determination unit 9 determines that the user is not an assistance-needed person (step ST9; NO), or after step ST10, the image determination unit 9 determines whether the user having entered the authentication area 102 is a monitoring-needed person, using the image data acquired by the image acquisition unit 8 (step ST11).

The image determination unit 9 outputs, to the management unit 12, a determination result indicating whether the user having entered the authentication area 102 is a monitoring-needed person or not, and in addition, if the user having entered the authentication area 102 is a monitoring-needed person, also indicating the specific reason such as carrying a dangerous article.

If the image determination unit 9 determines that the user having entered the authentication area 102 is a monitoring-needed person (step ST11; YES), the management unit 12 records the user as a monitoring-needed person in the person information database 13 (step ST12). If the specific reason such as carrying a dangerous article is indicated in the determination result from the image determination unit 9, the management unit 12 also records the specific reason in the person information database 13. In this operation, if information on the user has already been recorded in the person information database 13 by the operation at step ST6 or the like, the management unit 12 additionally records the determination result produced by the image determination unit 9 at step ST11 in association with the already-recorded information. Otherwise, if no information on the user has yet been recorded in the person information database 13, the management unit 12, for example, assigns a reference number to the user, and newly records the determination result produced by the image determination unit 9 at step ST11 in the person information database 13.

If the image determination unit 9 determines that the user having entered the authentication area 102 is not a monitoring-needed person (step ST11; NO), or after step ST12, the management unit 12 records location information acquired by the location acquisition unit 11 in the person information database 13 (step ST13). This location information indicates the location of the authentication area 102 entered by the user. In this operation, if information on the user has already been recorded in the person information database 13 by the process until step ST12 indicating that the user is an action-required person, the management unit 12 additionally records the location information in association with the already-recorded information. Otherwise, if the determination results produced by the determination unit 6 and by the image determination unit 9 both indicate that the user having entered the authentication area 102 is not an action-required person, the management unit 12 associates the result that the user having entered the authentication area 102 is not an action-required person, i.e., that the user is an ordinary person, with the location information, and then newly records the resultant data in the person information database 13.

As described above, the management unit 12 associates the determination results produced by the determination unit 6 and by the image determination unit 9 with the location information acquired by the location acquisition unit 11, and then records the resultant data in the person information database 13. The management unit 12 may also associate the authentication information acquired by the authentication acquisition unit 4 with the location information, in addition to these determination results, and record the resultant data in the person information database 13 on a per-user basis.

In addition, the management unit 12 constantly obtains location information indicating the location of the user detected by the location detection unit 10 via the location acquisition unit 11. Accordingly, when the user having entered the authentication area 102 moves afterward, the management unit 12 obtains location information after the movement, from the location acquisition unit 11, and thereby continues updating the location information of the user in the person information database 13.

The process described above is performed for each user having entered the authentication area 102, thereby generating the person information database 13 that enables images such as ones illustrated, for example, in FIGS. 3A and 3B to be generated.

The display control unit 14 controls the display unit 15 to display an image showing the location of an action-required person such as a non-carrier, using the person information database 13 (step ST14). In this operation, the display control unit 14 may control the display unit 15 to display an image showing only the location(s) of the action-required person(s), or may control the display unit 15 to display an image showing the locations of all the users having entered the authentication area 102 including the action-required person(s).

As described above, the person display control system 1 generates the person information database 13 in which the determination result of whether the user is an action-required person is associated with the location information, and utilizes the person information database 13 for the screen display on the display unit 15. Aggregation of information in a database enables the information to be displayed in various formats, such as a tabular display and a display in which locations are superimposed on a station floor map. Thus, the person display control system 1 can provide, at a place apart from an action-required person, a display for recognizing the location of the person.

Note that the foregoing description mentions that the image acquisition unit 8 and the image determination unit 9 may be incorporated in the image capture unit 7, or otherwise be configured in a server not shown communicable with the image capture unit 7 and with the management unit 12. In addition to these, the authentication acquisition unit 4, the determination unit 6, the location acquisition unit 11, the management unit 12, the person information database 13, and the display control unit 14 may also be configured in the server described above. In this case, the server sends and receives information to and from the read unit 2A, the sending unit 2B, the receiving unit 3, the person detection unit 5, the image capture unit 7, the location detection unit 10, and the display unit 15 existing in the station to cause the display unit 15 to display an image showing the location of an action-required person.

In addition, the foregoing description describes, by way of example, a case in which the person display control system 1 is applied to a station. However, the person display control system 1 is applicable to various buildings expected to be used by a large number of users, such as an airport and an office building.

In addition, when it is determined that a user having entered the authentication area 102 is a user having been previously recorded as an action-required person in the person information database 13 a preset number of times or more, using the person information database 13 and the authentication information acquired via the authentication acquisition unit 4, the determination unit 6 may output, to the management unit 12, a determination result indicating that the user is an action-required person. As illustrated in FIG. 3A, recording of the personal ID in the person information database 13 enables the determination unit 6 to search, using the personal ID in the authentication information acquired via the authentication acquisition unit 4, the person information database 13 to check whether the user having the personal ID has ever been recorded as an action-required person. Alternatively, as illustrated in FIG. 3A, in a case in which images of persons are recorded in the person information database 13, the determination unit 6 may search, using an image of the user having entered the authentication area 102 acquired via the image acquisition unit 8, the person information database 13 to check whether the user is a user previously recorded as an action-required person.

In addition, when it is only required to know whether the user having entered the authentication area 102 is a non-carrier or an unauthorized person to recognize the user as an action-required person, the person display control system 1 does not have to include the image acquisition unit 8 or the image determination unit 9.

Moreover, depending on a request of the user, information indicating a station where assistance is, or is not, needed may be stored in the IC card 104 as part of the authentication information. For example, a person that will be determined to be an assistance-needed person by the image determination unit 9 on the basis of an appearance feature, such as a user who uses a white cane, communicates, upon issuance of the IC card 104 or on other occasions, non-necessity for assistance at a familiar station, e.g., the boarding or alighting station in the pass coverage, and necessity for assistance at the other stations, and asks to store such information in the IC card 104 as part of the authentication information. Then, the management unit 12 records such authentication information in the person information database 13 during the recording process to the person information database 13. The display control unit 14 can use the person information database 13 to display which of the stations is a station where assistance is needed or a station where assistance is not needed, in the image on the display unit 15. Alternatively, the display control unit 14 may control the display unit 15 provided in a station specified as a station where assistance is needed, to display an image showing that the user is an assistance-needed person, and control the display unit 15 provided in a station specified as a station where assistance is not needed, to display an image showing that the user is not an assistance-needed person.

Meanwhile, a handicapped user without an appearance feature is difficult for the image determination unit 9 to identify as an assistance-needed person. The term "handicapped user without an appearance feature" herein refers to, for example, a hearing-impaired user, or a user who is ambulatory without a supportive device, but has difficulty in ascending and/or descending a staircase or in boarding and/or alighting from a train. For this reason, depending on a request of the user, information indicating being an assistance-needed person may be stored in the IC card 104 as part of the authentication information. For example, a hearing-impaired user communicates, upon issuance of the IC card 104 or on other occasions, the fact that the user is an assistance-needed person, and asks to store such information in the IC card 104 as part of the authentication information. Then, the management unit 12 records such authentication information in the person information database 13 during the recording process to the person information database 13. The display control unit 14 can use the person information database 13 to also display a handicapped user without an appearance feature as an assistance-needed person in the image on the display unit 15.

As described above, according to this first embodiment, the management unit 12 associates the determination results about an action-required person produced by the determination unit 6 and by the image determination unit 9 with the location information of a user, and then records the resultant data in the person information database 13; and the display control unit 14 controls, using the person information database 13, the display unit 15 to display an image showing the location of an action-required person. Thereby, it is possible to provide, at a place apart from the action-required person, a display for recognizing the location of the person.

In addition, the image acquisition unit 8 that acquires image data of the captured image of a user, and the image determination unit 9 that determines whether the user is an action-required person using the image data acquired by the image acquisition unit 8 are included; and the management unit 12 associates, with one another, the determination result produced by the determination unit 6, the location information acquired by the location acquisition unit 11, and the determination result produced by the image determination unit 9, and then records the resultant data in the person information database 13. This enables a determination to be made also for an action-required person such as an assistance-needed person who cannot be identified using the authentication information. Thus, the location of the person can be displayed on the display unit 15.

In addition, the management unit 12 associates, with one another, the determination result produced by the determination unit 6, the location information acquired by the location acquisition unit 11, the determination result produced by the image determination unit 9, and the image data acquired by the image acquisition unit 8, and then records the resultant data in the person information database 13. This enables the face and/or the like of the user to be displayed on the display unit 15.

In addition, the display control unit 14 controls the display unit 15 to display an image in which the location of an action-required person is superimposed on a map of the inside of the building where the authentication area 102 is provided. This enables station staff and/or the like to readily recognize the location of an action-required person.

Second Embodiment

A second embodiment will be described in terms of a type that allows station staff and/or the like to record a comment, action status, and/or the like with respect to a user.

Figure 6:
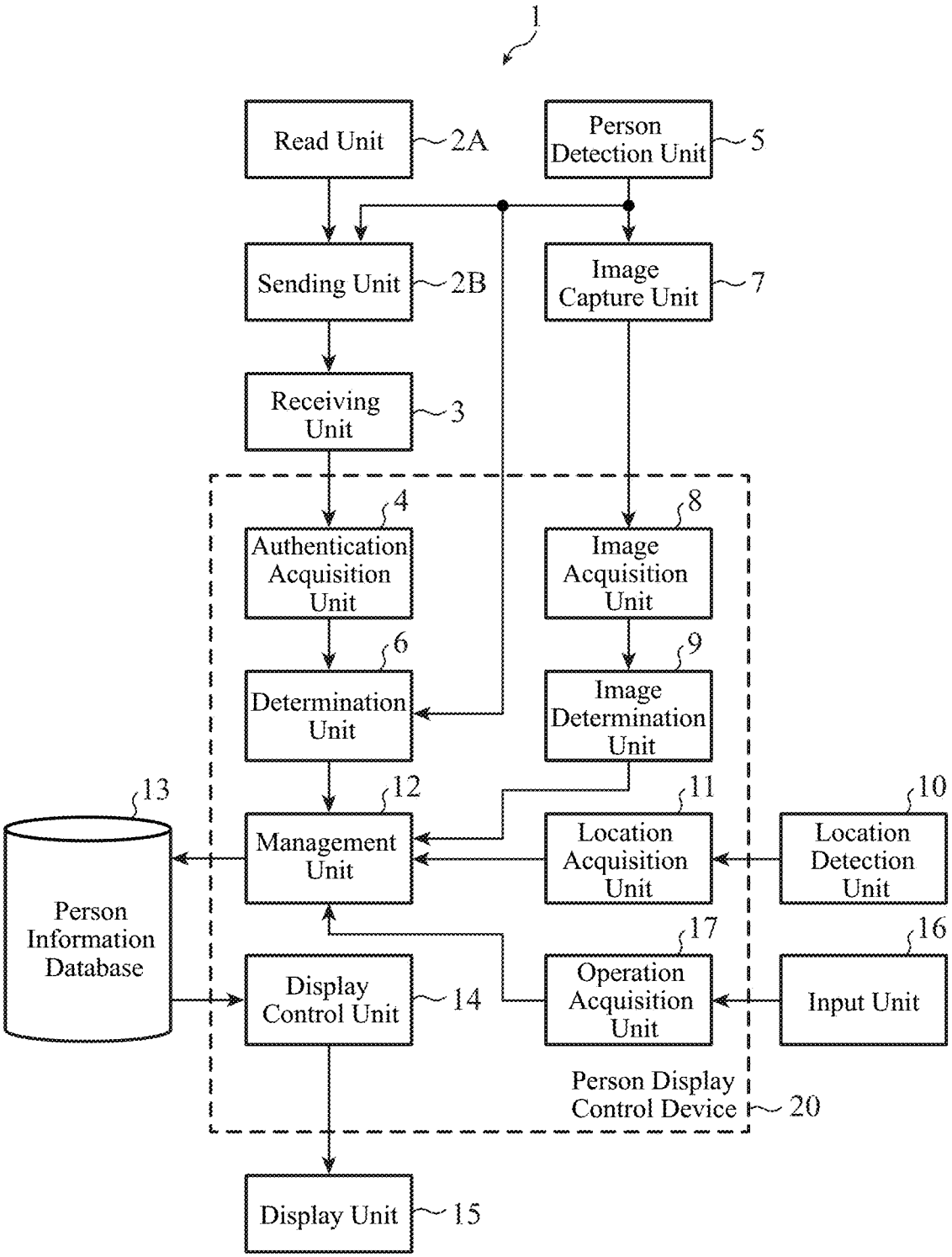
FIG. 6 is a diagram illustrating a configuration of a person display control system according to a second embodiment.

FIG. 6 is a diagram illustrating a configuration of a person display control system 1 according to the second embodiment. The components having functions identical or equivalent to those of the components already described for the first embodiment are designated by the same reference characters, and description thereof will be omitted or simplified as appropriate.

The person display control system 1 according to the second embodiment further includes an input unit 16 and an operation acquisition unit 17 in addition to the components illustrated in the first embodiment.

The input unit 16 receives operation of editing the person information database 13 performed by station staff and/or the like. The input unit 16 outputs operation information indicating the operation to the operation acquisition unit 17. The operation information indicates, for example, additional information on a user, an instruction to record additional information, or an instruction to delete additional information recorded.

The operation acquisition unit 17 acquires the operation information output by the input unit 16, and outputs the operation information to the management unit 12.

The management unit 12 edits the person information database 13 using the operation information acquired by the operation acquisition unit 17.

For example, when station staff operates the input unit 16 to input action status such as "assistance to be given", "monitoring", or "contact made", the action status is additionally recorded in the person information database 13. In addition to the action status, the person who performs action, a comment, and/or the like may also be additionally recorded. FIG. 7A is a diagram illustrating an example of display appearance of information recorded in the person information database 13 of the second embodiment. In addition to the pieces of information illustrated in FIG. 3A described in the first embodiment, the action status, the person who performs action, and a comment are recorded in the person information database 13 in the second embodiment. In addition, FIG. 7B is a diagram illustrating another example of display appearance of information recorded in the person information database 13 of the second embodiment.

Control of the display unit 15 by the display control unit 14 to also display, in addition to the location of an action-required person, additional information such as the action status for the person facilitates sharing of information among the station staff.

The input unit 16 is, for example, a set of buttons, a keyboard, or a touch panel. The display unit 15 and the input unit 16 may be implemented in a touch panel display in which a touch panel is integral with a display, and which is included in a smartphone or in a tablet terminal.

Similarly to the person display control device 20 according to the first embodiment, a person display control device 20 including the operation acquisition unit 17 according to the second embodiment can be implemented by the processing circuit 201 illustrated in FIG. 4A, or by the memory 202 and the CPU 203 illustrated in FIG. 4B.

As described above, this second embodiment allows the input unit 16 to receive operation of editing the person information database 13, and thus enables station staff and/or the like to record action status and/or the like in the person information database 13, thereby providing an advantage in facilitating sharing of information in addition to the advantage of the first embodiment.

In addition, the display unit 15 controlled by the display control unit 14 to display an image, and the input unit 16 are included in a touch panel display. This enables station staff and/or the like to check the location of an action-required person and to input action status and/or the like using one device.

Note that, with respect to the present invention, the foregoing embodiments may be combined in any manner, any component of each embodiment may be modified, and any component of each embodiment may be omitted, without departing from the scope of the invention.

INDUSTRIAL APPLICABILITY

As described above, the person display control device according to this invention is capable of providing a display for recognizing, at a place apart from an action-required person, the location of the person, and is thus suitable for use in managing users in a station, an office building, and the like.

REFERENCE SIGNS LIST

1: person display control system, 2: card holder, 2A: read unit, 2B: sending unit, 3: receiving unit, 4: authentication acquisition unit, 5: person detection unit, 6: determination unit, 7: image capture unit, 8: image acquisition unit, 9: image determination unit, 10: location detection unit, 11: location acquisition unit, 12: management unit, 13: person information database, 14: display control unit, 15: display unit, 16: input unit, 17: operation acquisition unit, 20: person display control device, 100: ticket gate walkway, 101: floor panel, 102: authentication area, 103: light emitting area, 104: IC card, 201: processing circuit, 202: memory, 203: CPU

The invention claimed is:

1. A person display control device comprising:

processing circuitry to acquire both a captured image of and authentication information of a user having entered an authentication area provided on a floor surface, the authentication information including assistance-needing information indicating whether the user needs assistance, the assistance-needing information being determined by performing image processing on the captured image of the user, wherein the assistance-needing information indicates that the user needs assistance based on detection of a particular object accompanying the user in the captured image;

to determine whether the user is an action-required person using acquisition information indicating whether the authentication information of the user has been acquired, or using the authentication information of the user acquired;

to acquire location information of the user;

to associate a determination result produced by the determination using the acquisition information or the authentication information with the location information acquired, and record the determination result along with the assistance-needing information in association with the user in a person information database;

and to control, on a basis of the determination result produced by the determination recorded in the person information database, a display to display an image showing a location of the action-required person.

2. The person display control device according to claim 1, wherein the processing circuitry determines whether the user is the action-required person, using image data acquired from the captured image, associates, with one another, the determination result produced by the determination using the acquisition information or the authentication information, the location information acquired, and a determination result produced by the determination using the image data, and records resultant data in the person information database, and determines whether the user is the action-required person on a basis of a combination of the determination result produced by the determination using the acquisition information or the authentication information and the determination result produced by the determination using the image data recorded in the person information database, and controls the display to display the image showing the location of the action-required person.

3. The person display control device according to claim 2, wherein the processing circuitry associates, with one another, the determination result produced by the determination using the acquisition information or the authentication information, the location information acquired, the determination result produced by the determination using the image data, and the image data acquired, and records resultant data in the person information database.

4. The person display control device according to claim 1, wherein the processing circuitry controls the display to display an image in which the location of the action-required person is superimposed on a map of an inside of a building, the authentication area being provided in the building.

5. A person display control system comprising:

the person display control device according to claim 1;

a reader to read the authentication information of the user; and a transmitter to send the authentication information read by the reader.

6. A person display control system comprising:

the person display control device according to claim 1; and a person detector to detect that the user has entered the authentication area.

7. A person display control system comprising:

the person display control device according to claim 1; and an input device to receive operation of editing the person information database, and output operation information indicating the operation, wherein the processing circuitry edits the person information database using the operation information.

8. The person display control system according to claim 7, wherein the display controlled by the processing circuitry to display the image, and the input device are included in a touch panel display.

9. A person display control method comprising:

acquiring both a captured image of and authentication information of a user having entered an authentication area provided on a floor surface, the authentication information including information as to whether the user needs assistance, the assistance-needing information being determined by performing image processing on the captured image of the user, wherein the assistance-needing information indicates that the user needs assistance based on detection of a particular object accompanying the user in the captured image;

determining whether the user is an action-required person using information indicating whether the authentication information of the user has been acquired, or using the authentication information of the user acquired;

acquiring location information of the user;

associating a determination result produced by the determination with the location information acquired, and recording the determination result along with the assistance-needing information in association with the user in a person information database; and controlling, on a basis of the determination result produced by the determination recorded in the person information database, a display to display an image showing a location of the action-required person.

* * * * *